United States Patent [19]

Daly et al.

[11] Patent Number: 4,975,080

[45] Date of Patent: Dec. 4, 1990

[54] LOCKING MEANS FOR ELECTRICAL INTERCONNECTING STRUCTURES

[75] Inventors: John K. Daly, Scottsdale, Ariz.; Songchin S. Lu, Santa Monica, Calif.; Frederick H. Rider, Glendale, Ariz.

[73] Assignee: AMP Incorporated, Harrisburg, Pa.

[21] Appl. No.: 454,553

[22] Filed: Dec. 21, 1989

Related U.S. Application Data

[63] Continuation-in-part of Ser. No. 338,079, Apr. 14, 1989, Pat. No. 4,915,650, and a continuation-in-part of Ser. No. 341,864, Apr. 21, 1989, Pat. No. 4,900,264.

[51] Int. Cl.[5] ..... H01R 9/07

[52] U.S. Cl. ..... 439/498; 439/422; 439/465; 29/866

[58] Field of Search ..... 439/421–424, 439/492–499, 67, 77, 465; 29/866, 867

[56] References Cited

U.S. PATENT DOCUMENTS

| | | | |
|---|---|---|---|
| 2,080,750 | 5/1937 | Thompson | 29/149.5 |
| 3,138,658 | 6/1964 | Weimer, Jr. | 174/94 |
| 3,247,316 | 4/1966 | Weimer, Jr. | 174/94 |
| 3,752,901 | 8/1973 | Kuo | 174/84 C |
| 3,937,403 | 2/1976 | Lawson | 439/424 |
| 4,241,498 | 12/1980 | Brandeau | 29/861 |
| 4,248,493 | 2/1981 | Kuo | 339/97 R |
| 4,263,474 | 4/1981 | Tennant | 174/84 C |
| 4,859,204 | 8/1989 | Daly et al. | 439/424 |
| 4,867,700 | 9/1989 | Kreinberg | 439/422 |
| 4,902,245 | 2/1990 | Olsson | 439/492 |
| 4,913,662 | 4/1990 | Noy | 439/498 |

*Primary Examiner*—David L. Pirlot
*Attorney, Agent, or Firm*—Anton P. Ness

[57] ABSTRACT

Upper and lower connecting structures for use with flat power cable by being applied to major surfaces thereof, include arrays of cable-engaging bosses alternating with boss-receiving relief recesses; when pressed together the structures at least press conductor strips out of the cable plane and into opposing recesses of the opposing structures, exposing conductor strip edges for electrical connection and defining an array of interdigitated joints. The upper and lower structures are mechanically locked together by forming pockets in the side walls of the relief recesses of each structure to be disposed beside forwardmost portions of the cable-engaging bosses of the opposing structure upon application to the cable, and then deeply staking each of the interdigitated joints to split axially the forwardmost portion of the cable-engaging bosses and force the split portions laterally into the pockets, so that a portion of each structure is locked behind an associated portion of the other structure. The method and structures can be used for terminating an end portion of a cable for connection to another electrical article, or for forming a tap or splice connection between two flat cables.

26 Claims, 7 Drawing Sheets

20
16
20
10
60
2
36
50
6
54
34
56
58
6
54
42
12
44
26
38
28
40
14
2
80
20
22
46
22
18
24
20

LOCKING MEANS FOR ELECTRICAL INTERCONNECTING STRUCTURES

REFERENCE TO RELATED APPLICATIONS

This is a Continuation-in-part of U.S. Pat. application Ser. No. 07/338,079 filed Apr. 14, 1989, now U.S. Pat. No. 4,915,650 and a Continuation-in-Part of U.S. Pat. application Ser. No. 07/341,864 filed Apr. 21, 1989, U.S. Pat. No. 4,900,264.

FIELD OF THE INVENTION

The present invention relates to the field of electrical connections and more particularly to interconnecting flat power cables.

BACKGROUND OF THE INVENTION

U.S. Pat. Nos. 4,859,204 and 4,867,700 disclose a transition adapter which is crimped onto a flat power cable by penetrating the insulation covering the cable's conductor and also shearing through the conductor at a plurality of locations. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. U.S. Pat. No. 4,915,650 discloses a similar transition adapter separable into two discrete adapters which is especially useful with dual conductor flat cable, wherein a pair of parallel spaced coplanar flat conductor strips having insulation extruded therearound define power and return paths for electrical power transmission. The adapters have opposed plate sections disposed along respective major surfaces of the cable, the plate sections including termination regions transversely thereacross having arrays of shearing wave shapes alternating with relief recesses of equal width. The wave shapes extending outwardly from the cable-proximate side and toward relief recesses in the opposed plate section, and when the plate sections are pressed together with the cable therebetween, the arrays of wave shapes shear the cable into strips and simultaneously press the sheared strips out of the plane of the cable and into the opposing relief recesses, forming a series of interlocking wave joints with the cable while exposing newly sheared edges of the cable conductor or conductors for electrical connection therewith. Low resistance copper inserts along the cable-remote surfaces of the adapters include wave shapes conforming to the adapter wave shapes so that the sheared conductor strips become disposed between sides of the insert wave shapes, as do the shearing edges of the adjacent wave shapes of the opposing adapter. Thereafter a staking process deforms the metal of the low resistance copper inserts against the conductor edges to define gas-tight, heat and vibration resistant electrical connections with the cable conductor and with the transition adapter, so that the inserts are electrically in series at a plurality of locations between the conductor and the adapter. A contact section is integrally included on the transition adapter and extends from the now-terminated cable end, enabling mating with corresponding contact means of an electrical connector, or a bus bar, or a power supply terminal, for example.

U.S. Pat. No. 4,900,264 discloses electrical interconnection of one dual (or single) conductor flat power cable to another, forming a splice or a tap interconnection between the cables which mechanically joins the cables and electrically interconnects the respective ones of the pairs of cable conductors. The cables are first stacked with the ones of the conductors of each cable to be interconnected being adjacent each other. A pair of wave crimp structures are associated with each pair of conductors to be interconnected, with a lower one of the structures being disposed transversely below the cables and an upper one being disposed transversely above the cables opposed from the lower one; the two pairs of structures for the two pairs of conductors are spaced from each other along the cables and will both be disposed within a common housing at the interconnection site. Each pair of upper and lower structures define along one half adjacent the conductors to be interconnected, opposing arrays of shearing wave shapes and alternating recesses comprising cooperating shearing edges; the other half of each contains no shearing edges so that no electrical connection is made with the conductors not to be interconnected. The structures will then be pressed against the cable therebetween, shearing strips of the conductors to be interconnected and pressing alternating ones of the strips above and below the planes of the cables and exposing newly sheared conductor edges to be electrically interconnected by metal of the structures. Flanges of the upper and lower structures extend outwardly beyond both lateral edges of the cables and converts, and rivets are placed through aligned flange holes and staked to lock the structures to each other sandwiching the cables therebetween. The wave shapes of the low resistance metal insert of the structure are staked to deform the metal tightly against adjacent sheared conductor edges of the conductor strips between the insert wave shapes, defining a plurality of gas-tight, heat and vibration resistant electrical connections thus interconnecting the associated conductors of the pair of flat cables.

It is desired to provide a means for terminals for flat power cables and interconnectors for two such flat power cables, having upper and lower structures with opposing arrays of wave shapes for electrically connecting to flat conductors thereof, to assuredly self-secure to each other for improved mechanical fastening to each other and to the cable or cables.

It is also desired that such self-securing means be integral and easily activated upon cable termination.

It is further desired that such self-securing means not enlarge the outer envelope of the terminals or interconnecting structures enabling them to be compact.

SUMMARY OF THE INVENTION

The present invention provides improved insert members of wave crimp terminals for flat power cable terminations and of wave crimp interconnecting structures for the electrical interconnection of one flat power cable to another. Such insert members are used with adapter members that include transverse arrays of wave-shaped embossments alternating with arcuate shapes defining relief recesses; the insert members likewise have wave shapes alternating with relief apertures. The insert members are secured along outwardly facing surfaces of the adapter members, to define upper and lower opposed structures, so that the insert wave shapes underlie the adapter member wave-shaped embossments, and the arcuate relief shapes of the adapter member are disposed in the insert relief apertures. When the upper and lower structures are aligned with their arrays of wave shapes of each structure opposed from relief shapes and apertures of the other structure and are pressed together against the cable or cables therebetween, the adapter wave shapes at least press strips of conductors of the flat power cable or cables out of the plane of the cable or cables into apertures of the insert members, for conductor edges to be engaged by metal of the adapter member and the insert members. The transverse array of opposed, offset wave-shaped embossments of the adapter members of the upper and lower structures define a like transverse array of interdigitated wave joints with the cable conductor strips. Completing the termination or interconnection process, the wave joints are split axially and portions thereof forced laterally; the insert members are then staked to urge the metal thereof laterally against the conductor edges and side edges of the wave shapes of the opposing adapter members to form a plurality of gas-tight, heat and vibration resistant electrical connections with the cable conductor, or associated conductors of a pair of cables being interconnected.

The improvement in the insert members of the present invention comprises providing recess means in at least one vertical side wall of at least one of the apertures of each insert member, so that upon termination a portion of a wave-shaped embossment of the adapter member of the opposing wave crimp structure will be disposed laterally of the recess means; thereafter, upon splitting of the wave joint within the insert aperture by blade-shaped tooling of the application apparatus, a portion of the crest of the wave shape will be split and forced laterally into the recess means. Such a formation places a portion of the metal of each adapter behind a portion of the metal of the opposing adapter upon completion of the termination process, locking the upper and lower structures together.

In one embodiment the inserts have defined adjacent at least one of the relief apertures a pocket extending laterally therefrom, into which metal of an adjacent wave shape of the adapter of the opposing wave crimp structure will be deformed during the process of splitting all waves of the array of wave joints; with a portion of the split crest of the wave shape of the adapter of each structure disposed behind metal of the insert of the other structure, the structures are thus locked together providing mechanical integrity to the termination or interconnection without the need of riveted lateral flanges as in U.S. Pat. No. 900,264. In another embodiment the recess means comprises chamfers along the side edges at the crests of the insert wave shapes; upon wave splitting the split portions of the crests of each wave shape of the adapter of the opposed wave crimp structure previously adjacent the chamfers will be forced laterally into the reliefs defined by the chamfers and become locked behind the crests of the now-split portions of the wave shapes of the insert's own adapter member, defining a transverse array of locking structures It is an objective of the present invention to provide a means for assuring the mechanical securing together of upper and lower wave crimp structures to a flat power cable or pair of flat power cables to define a termination or interconnection, respectively.

It is another objective to provide an integral means easily activated during application of the terminating or interconnecting structures to the cable or cables.

It is yet another objective to provide such an integral means which permits the structures to define a compact envelope upon completion of the application process, having minimal height, width and length.

Embodiments of the present invention will now be discussed with reference to the accompanying drawings.

DETAILED DESCRIPTION OF THE PREFERRED EMBODIMENT

Figure 7A:
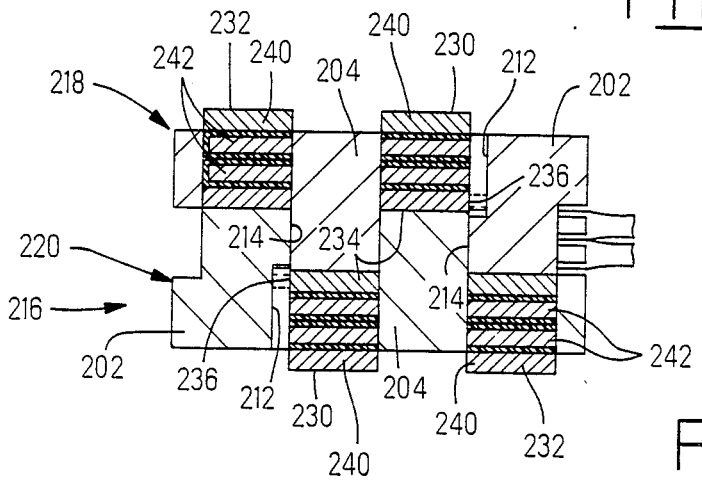
FIGS. 7A and 7B are cross-sectional views of upper and lower interconnecting structures having the insert of FIG. 6 upon being terminated to the cables, before and after staking respectively.
Figure 7B:
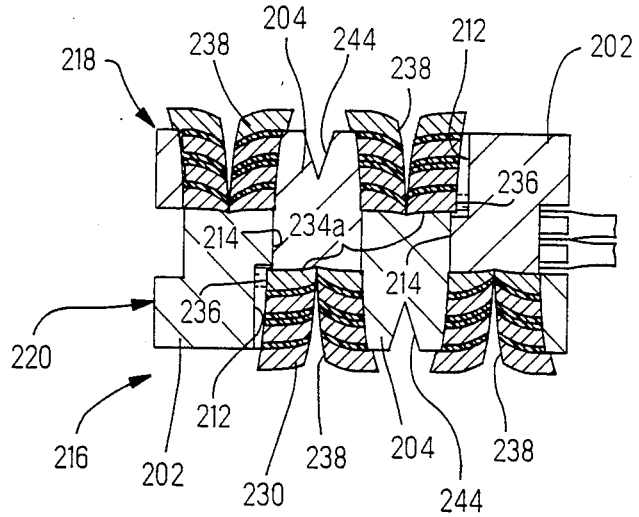
Figure 8A:
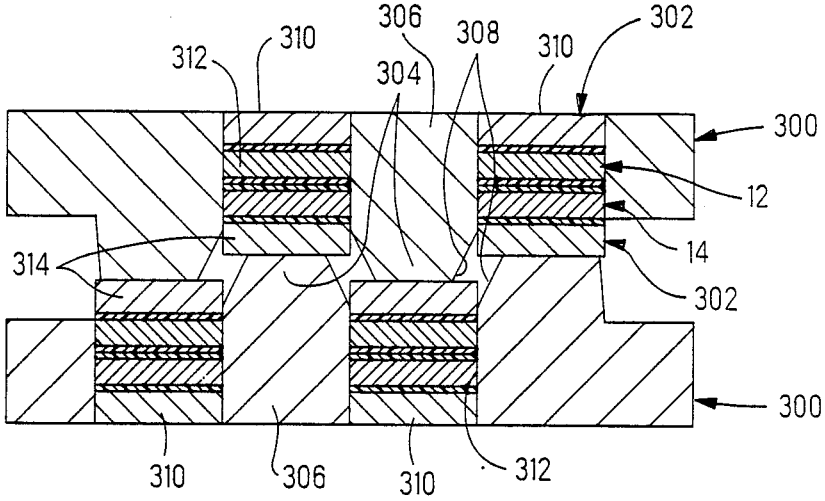
FIGS. 8A, 8B and 8C are cross-sectional views of upper and lower interconnecting structures having another embodiment of insert having notches for generating self-locking upon cable termination, applied to the cables before wave splitting, after wave splitting, and after insert staking, respectively.
Figure 8B:
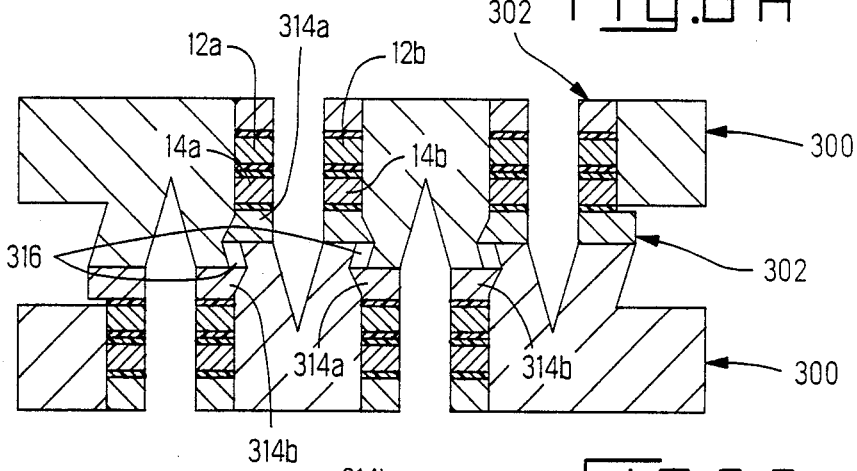
Figure 8C:
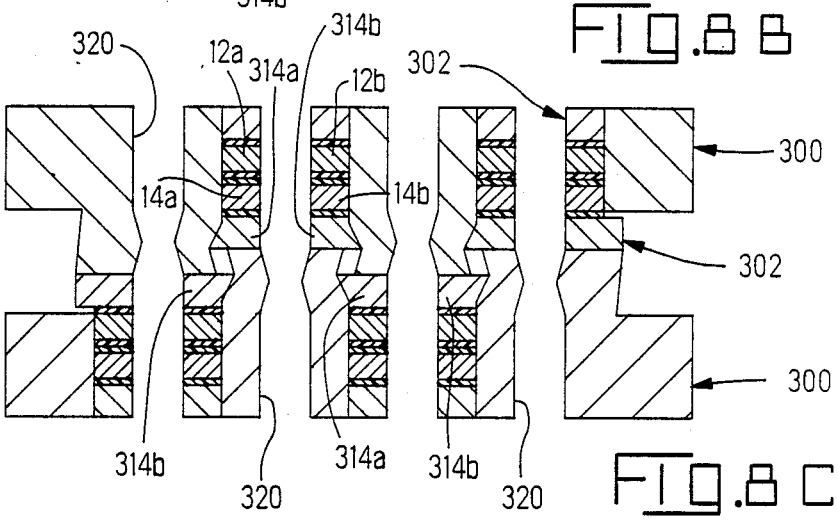
Figure 9:
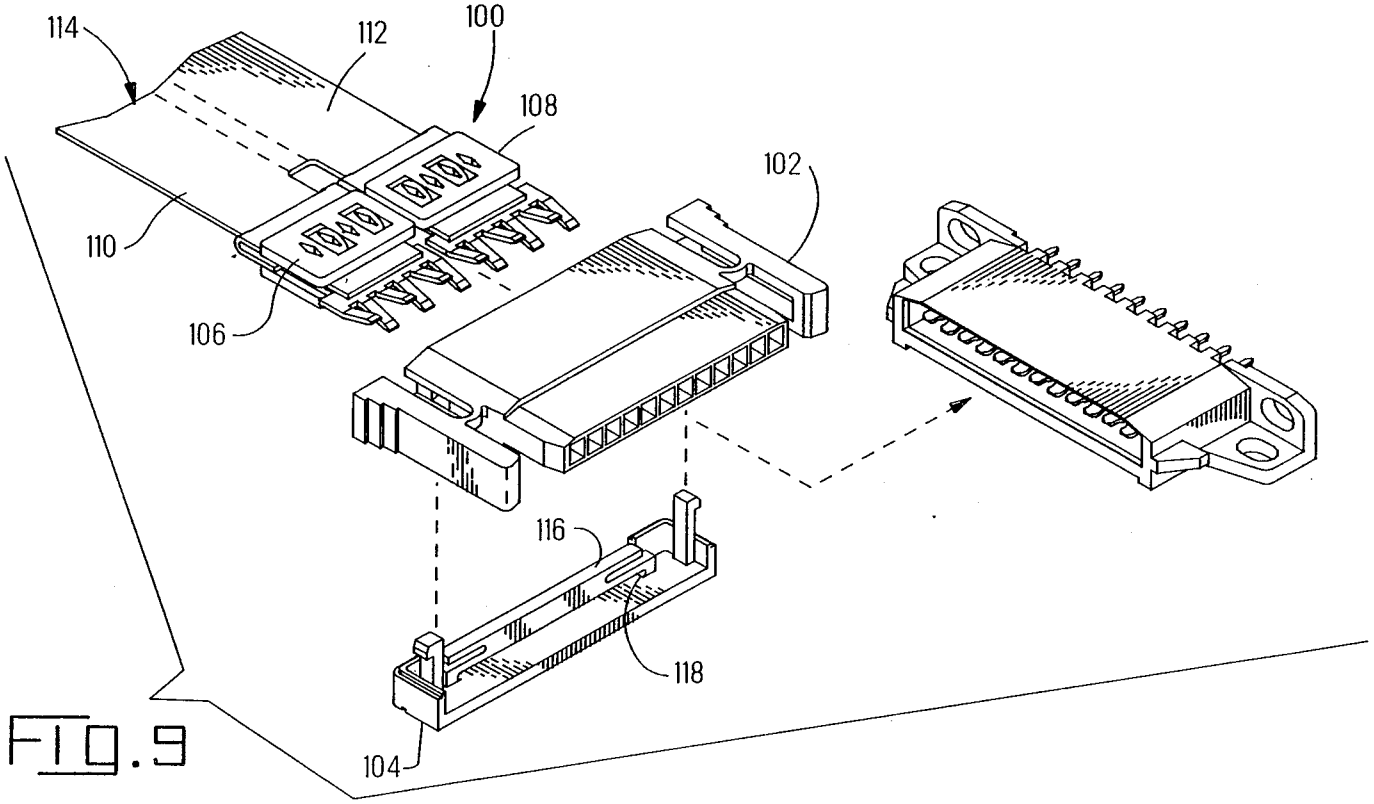
FIG. 9 is a perspective view of a connector for a flat power cable termination and a connector matable therewith, with the terminated flat cable exploded from the housing and a rear cover member also exploded therefrom, with which the inserts of the present invention may be used.

FIGS. 1 through 8 illustrate an interconnection of a first flat power cable with a second such cable, which may be single or dual conductor, while FIG. 9 illustrates a termination of such a flat power cable for being interconnected with another electrical article by means of mating and separable contact means. Wave crimp inserts in general are shown and discussed with respect to FIGS. 1 to 4, while inserts of the present invention are shown and discussed in particular with respect to FIGS. 5 to 8B, in order to facilitate understanding of the self-locking mechanisms. The interconnection shown in FIGS. 1 to 8 is a tap connection 10 between a main dual conductor flat cable 12 and a tap cable 14 of similar construction, as more fully set forth in application Ser. No. 07,454,656 filed Dec. 21, 1989. The interconnection of the present invention may also be used to splice together a pair of flat cables. The housing assembly can comprise dielectric upper and lower housing members 16,18 which are secured together to at least provide insulation and physical protection of the cable interconnection site. Members 16,18 are shown being hermaphroditic and securable together by semicylindrical posts 20 at diagonally opposed corners force-fittable into corresponding semicylindrical apertures of the other housing member where apertures 22 include engaging ribs 24 protruding radially into the apertures which become plastically deformed to firmly hold the posts in the apertures. Cables 12,14 are dual conductor flat power cable 12,14 wherein a pair of flat conductors 26,28;38,40 (in phantom in FIG. 1) have an insulative coating extruded therearound and defining insulative medial strips 30,32 between the respective pairs of conductors.

Figure 1:
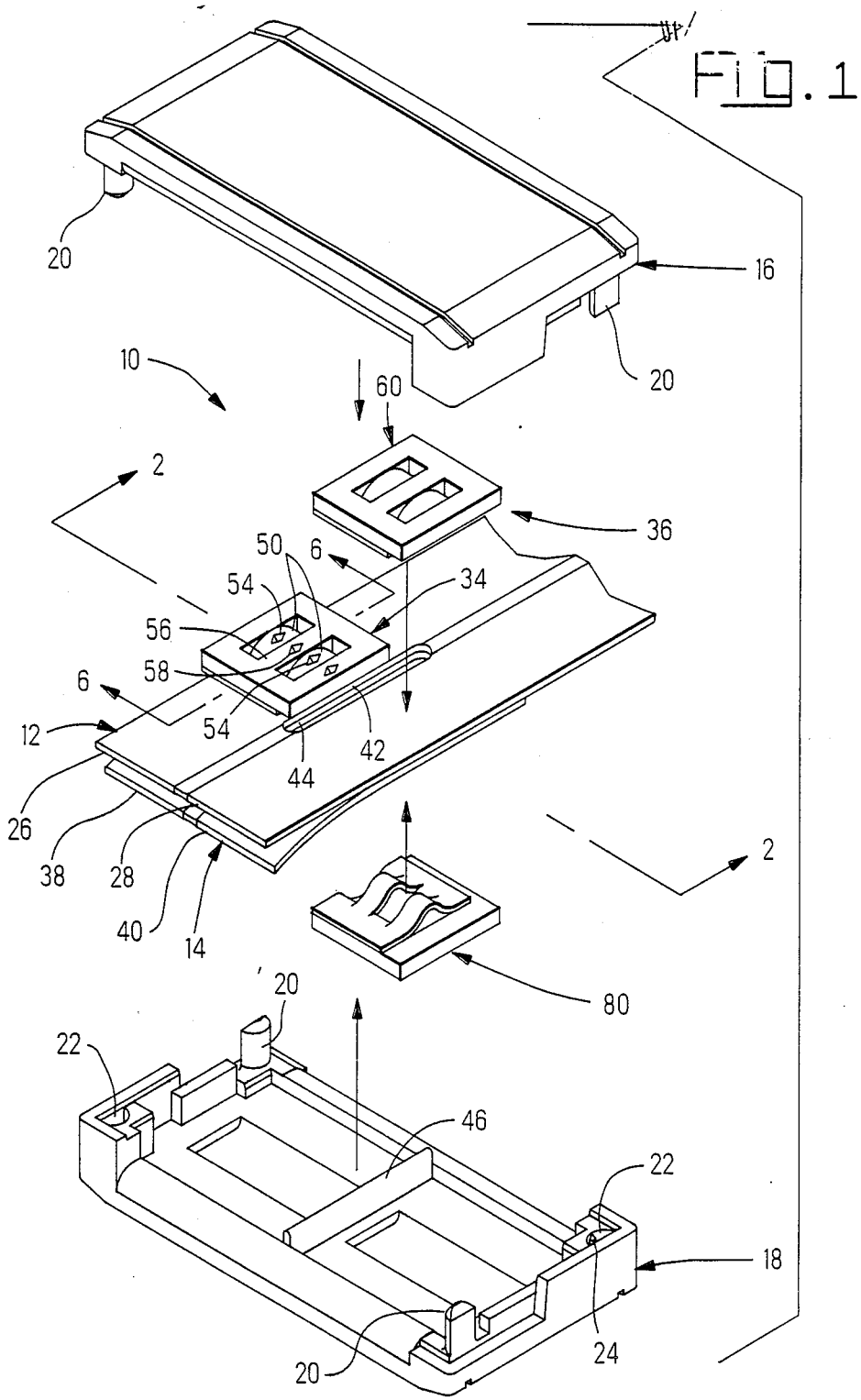
FIG. 1 is a perspective view of a tap connection of dual conductor main and tap cables, with the housing members exploded from the tap connection, revealing one interconnecting structure terminated to and interconnecting a respective pair of conductors of the main and tap cables after staking, and upper and lower members of another like structure about to be terminated to the other pair of cable conductors.

In FIG. 1 two interconnecting structure assemblies 34,36 are shown each of which interconnects respective ones of the conductors of the main and tap cables, while sandwiching both cables therewithin. Assembly 34 electrically interconnects conductor 26 of main cable 12 with conductor 38 of tap cable 14. Assembly 36 will electrically interconnect conductors 28,40 when pressed together against the cables. Cables 12,14 are previously prepared for termination by having punched therethrough vertically aligned elongate slots 42,44 therethrough along the medial strips 30,32 thereof, removing at least most of the width of the medial strips. Medial slots 42,44 permit axially extending barrier wall sections 46 of the housing members 16,18 to extend therethrough providing dielectric material between the interconnecting structures 34,36 after termination to assure electrical isolation of the circuits after interconnection. Slots 42,44 also enable registration tooling of the termination apparatus (not shown) to accurately locate and hold the cables in position during termination. The interconnections occur at sides of each of a plurality of alternating upper and lower wave joints, upper wave joints 50 being visible in the Figure.

Figure 2:
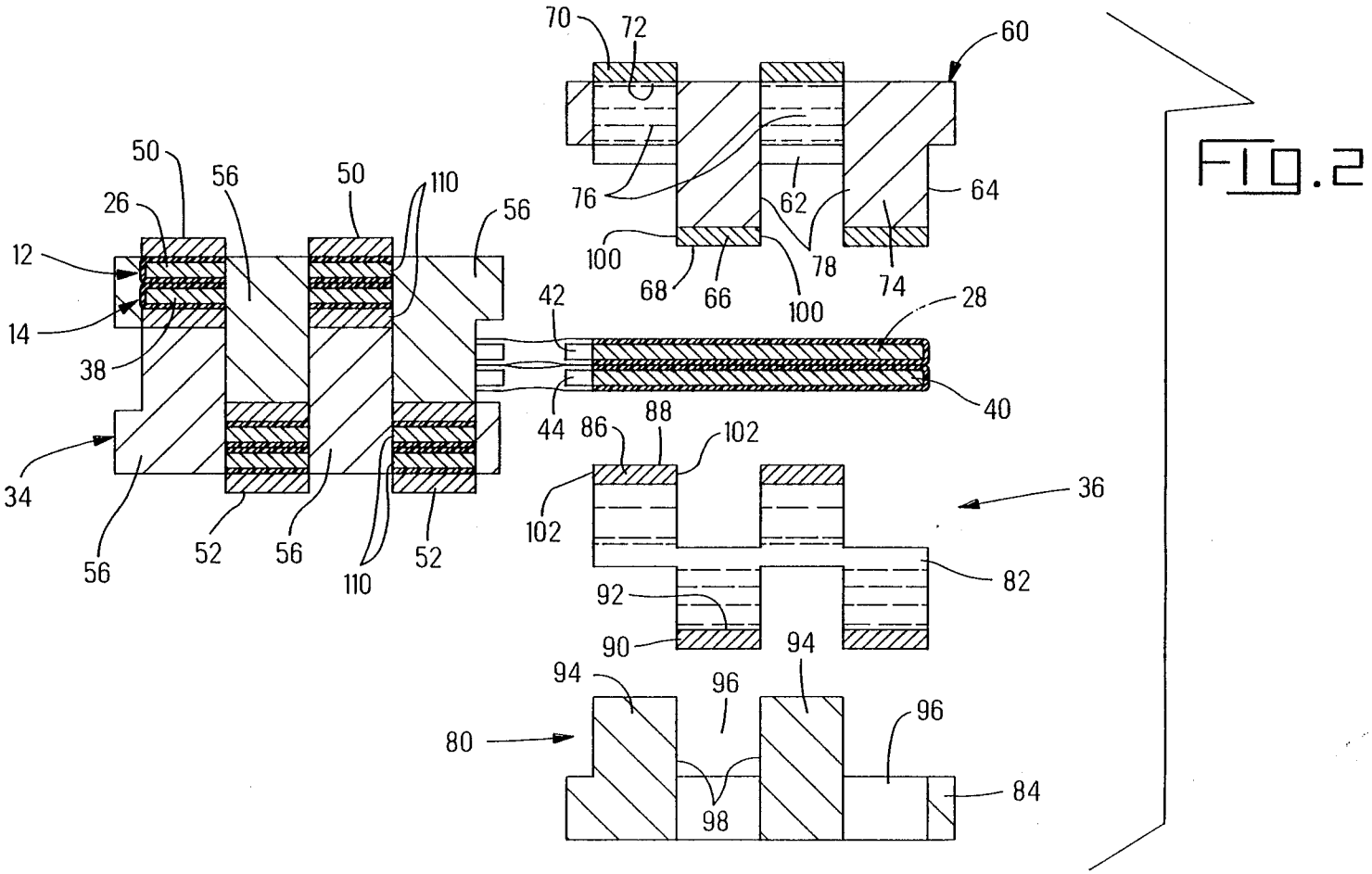
FIG. 2 is a cross-sectional view across the cables taken generally along lines 2—2 of FIG. 1, showing the array of wave joints interconnecting the conductors of the left side of the main and tap cables, and showing the upper and lower structures of the present invention on the right.
Figure 3:
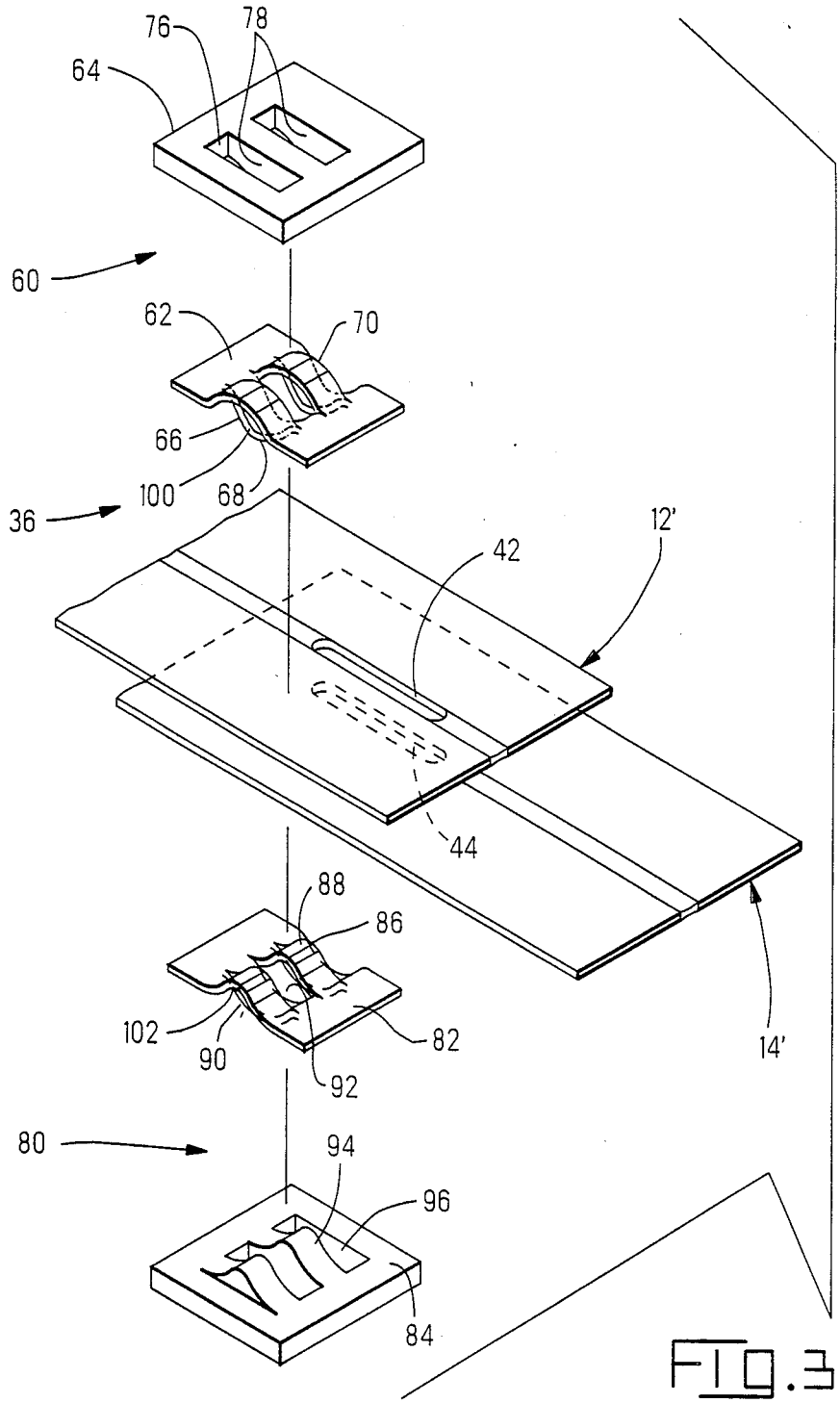
FIG. 3 is a perspective view of the adapter members and insert members of the upper and lower interconnecting structures of FIGS. 1 and 2.
Figure 4:
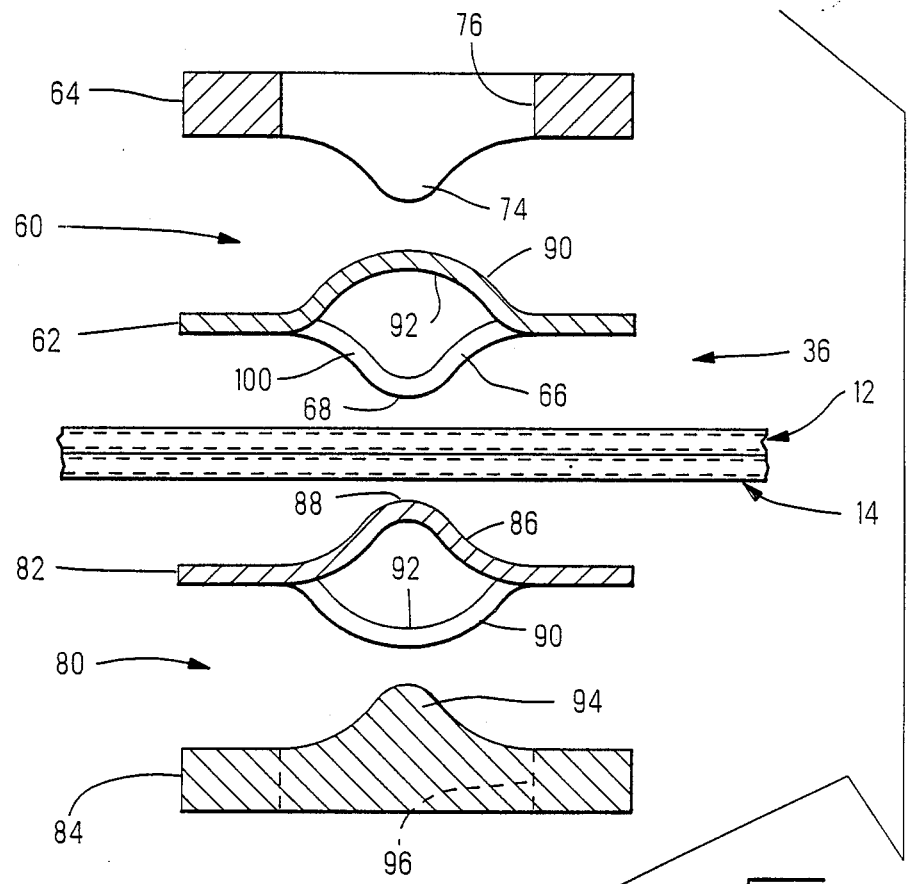
FIG. 4 is a longitudinal section view through an interconnection site showing upper and lower adapter and insert members exploded from the two cables.

FIG. 2 represents a simplified cross-section through interconnecting structure assembly 34, showing the plurality of upper wave joints 50 alternating and interlocking with lower wave joints 52. Wave joints 50,52 are similar to the type disclosed in U.S. Pat. Nos. 4,859,204 and 4,867,700 which are incorporated herein by reference. Each wave joint 50,52 is preferably split as depicted at 54 in FIG. 1 by a staking process which strengthens the joint. Between the upper wave joints 50 are sections of bulk metal 56 of structure assembly 34 which sections are staked as depicted at 58 of FIG. 1 which deforms the bulk metal laterally tightly against the sheared edges of the conductors 26,38 forming gas-tight joints therewith; the prior splitting of the wave joints at 54 imparts strong but compliant resistance to the staking of the bulk metal sections and also provides stored energy in the joint which helps maintain the gas-tight nature of the interconnections during in-service use which commonly involves elevated temperatures and vibration. After interconnection and during in-service use, adapter members 62,82 (FIG. 3) assist in confining the relatively yielding conductors 26,38 thereby inhibiting stress relaxation which otherwise would reduce stored energy in wave joints 50,52.

Referring to FIGS. 2 through 5, upper interconnecting structure 60 is comprised of an upper transition adapter member 62 and an upper insert member 64, while lower interconnecting structure 80 is comprised of a lower transition adapter member 82 and a lower insert member 84. Adapter members 62,82 may be stamped and formed for example from a sheet of Olin Copper Alloy 197 in half hard temper about 0.025 inches thick which is nickel underplated and silver plated, preferably, and treated for tarnish resistance. Insert members 64,84 may be for example of dead soft Copper CDA 110 generally about 0.066 inches thick which is nickel underplated and silver plated, preferably, and treated for tarnish resistance. Adapter members 62,82 are designed to be hermaphroditic, as are insert members 64,84 and also housing members 16,18, thus simplifying inventory and assembly by requiring fewer different parts to establish the tap or splice connector 10. The interconnection regions of the upper and lower assemblies 34,36 are preferably intermatable with each other when opposed and aligned and properly oriented when applied to the cables. Preferably each insert member is secured to its associated adapter member to be easily handled as a unit; such securing may be by force-fitting of the arcuate adapter relief shapes within the insert relief apertures; alternatively the inserts may be slightly prestaked as disclosed in U.S. Pat. No. 4,859,204.

The interconnection region of upper adapter 62 includes a pair of downwardly protruding wave shapes 66 each including a wave crest 68, alternating with a pair of upwardly directed arcuate shapes 70 having widths identical to the width of a wave shape 66 and defining relief recesses 72. The array of wave crests 68 and alternating relief recesses 72 is to be oriented transversely with respect to the cables. The interconnection region of lower adapter member 82 is similar to upper adapter 62 but is configured to cooperate with upper adapter 62; lower adapter 82 includes a pair of upwardly protruding wave shapes 86 each including a wave crest 88, alternating with a pair of downwardly directed arcuate shapes 90 having widths identical to the width of a wave shape 86 and defining relief recesses 92. Each wave shape 66,86 is defined between a pair of parallel vertical side edges 100,102 extending axially with respect to the cable. Together edges 100,102 will cooperate during termination to comprise shearing edges to shear the cable conductors during termination, if the cables have not been previously tool-sheared.

Upper insert member 64 includes an adapter-proximate surface which will be disposed against the cable-remote surface of upper adapter 62, and is shaped to conform closely therewith. Upper insert 64 includes a pair of wave shapes 74 separated by one of apertures 76 and having vertical side walls 78, with wave shapes 74 corresponding with wave shapes 66 of adapter 62 and apertures 76 receiving arcuate shapes 68 thereinto. Likewise lower insert member 84 includes a pair of wave shapes 94 separated by one of a pair of apertures 96 and having vertical side walls 98, with apertures 96 receiving thereinto arcuate shapes 90.

Figure 5:
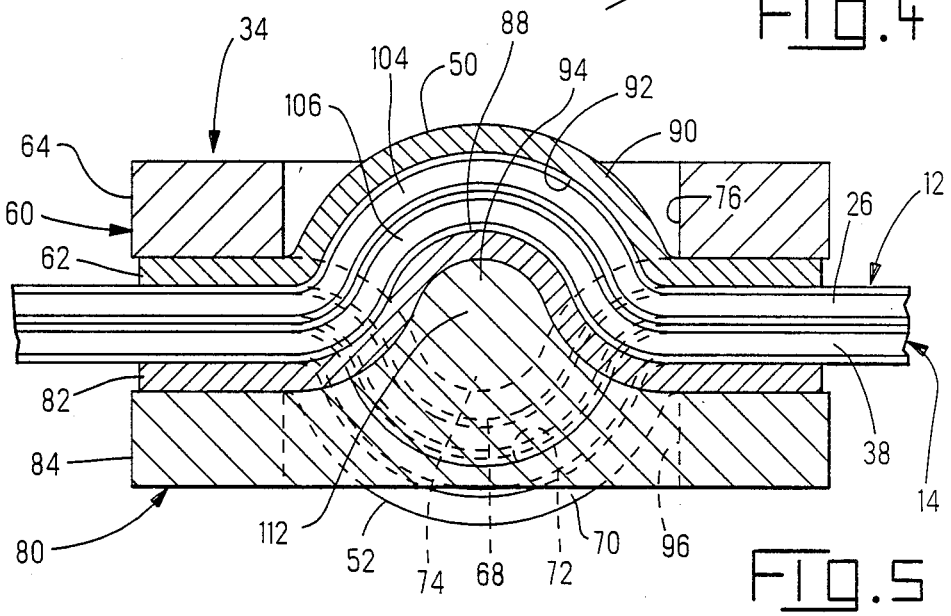
FIG. 5 is a longitudinal section view through a wave joint and generally along lines 5—5 of FIG. 1 showing the wave joint formed by an interconnecting structure upon termination.

FIG. 5 illustrates the structure of a wave joint 50, and also of a lower wave joint 52 (in phantom), after termination of upper and lower interconnecting structures to main and tap cables 12,14. Side edges 100,102 of wave shapes 66,86 have sheared conductors 26,38 into strips 104,106 and wave shapes 66,86 have pressed the sheared conductor strips into the opposing relief recesses 72,92 respectively within apertures 76,96. The wave crests 68,88 have been designed and dimensioned with respect to the nominal cable thicknesses so that the newly sheared edges 110 (see FIG. 2) of the sheared conductor strips are moved past the vertical side edges of the wave shapes of the opposing wave shapes and past substantial vertical areas of the side surfaces of the wave shapes of the opposing inserts. This is indicated in FIG. 5 by the wave overlap area 112, and is best seen in FIG. 2 where newly sheared conductor edges 110 can best be identified. Especially after wave joint splitting and insert wave staking as in FIG. 1 at 54 and 58 by blades of the terminating apparatus (not shown) after the shearing and extrusion has occurred, as taught in U.S. Pat. No. 4,859,204, assured gas-tight connections are formed between sheared conductor edges 110 and both the metal comprising the side walls 78,98 of insert apertures 76,96 and wave shapes 74,94 and the metal comprising the side edges 100,102 of the adapter wave shapes 66,86 at a plurality of locations across the terminating region, interconnecting the conductors 26,38 of the main and tap cables 12,14. Alternatively, the cables can be sheared by tooling to define the conductor strips which may then be pressed out of the plane of the cable by the adapter wave shapes for the previously sheared conductor edges to be disposed adjacent the metal side edges of the adapter wave shapes and the side walls of the insert wave shapes.

The interconnecting structures of the present invention are adapted to provide a positive self-locking means after termination, whereby the upper and lower assemblies positively lock to each other thus securing themselves tightly to each other with the cable portions clamped therebetween; the mechanical fastening attained by the self-locking means thus protects the terminations and their gas-tight interconnections against strain and vibration. FIGS. 6 to 8B illustrate several examples of such self-locking means; the inserts are adapted to provide for metal of the opposing adapter waves to be deformed laterally thereinto during the wave splitting procedure.

Figure 6:
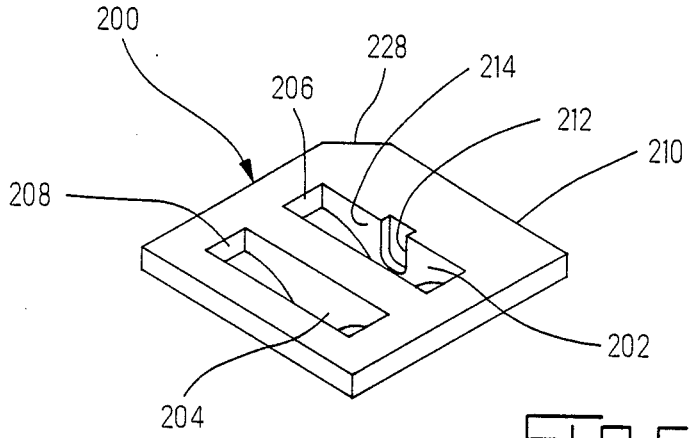
FIG. 6 is an enlarged perspective view of one embodiment of insert of an interconnecting structure having a pocket along a side wall of a relief aperture used to generate a lock upon staking for enhanced mechanical securing of the upper and lower interconnecting structures to each other and to the cables.

In FIGS. 6 and 7A an insert 200 of the present invention includes a pair of insert wave shapes 202,204 alternating with a pair of apertures 206,208. Wave shape 202 is disposed closer to a lateral edge 210 of insert 200 and includes a pocket 212 of narrow width extending along vertical side wall 214 almost to the surface of the crest of the wave. Electrical interconnection 216 of FIG. 7A uses upper and lower assemblies 218,220 which utilize a pair of inserts 200,222 with adapters 224,226 identical to adapters 62,82 of FIG. 4. Also shown in FIG. 6 is a chamfered corner 228 which provides a means for locating and orienting the insert in the application tooling along with a corresponding chamfer on the associated adapter to which it is secured, for assuring the appropriate precise alignment of the upper and lower assemblies of each interconnecting structure.

In FIG. 7A it can be seen that each of inner and outer wave joints 230,232 of interconnection 216 extends deeply enough into the relief aperture 206,208 of the far insert for the wave crest 234 of the near adapter to be located within the aperture, with side edges 236 of the laterally outermost wave shapes of each adapter to be adjacent a pocket 212 in the vertical side wall 214 of the adjacent wave shape 202 of the respective far insert. In FIG. 7B the waves 230,232 are split by staking tooling (not shown) as in U.S. Pat. No. 4,859,204, to a greater depth inwardly from the blade-receiving surface of the arcuate relief shape 238 of the near adapter in order to split the entire wave joint to assure splitting wave crest 234 of the far adapter to be split and forced laterally in the same manner that the conductor strips 240 are split and the split portions forced laterally. A portion of wave crest 234 adjacent pocket 212 of the insert of the opposing assembly is deformed into pocket 212, defining a lock to hold the completed, staked interconnection 216 together after the remaining insert staking is performed as described with respect to FIG. 1. With one of the upper and lower assemblies having the pocket near the outside cable edge and the other having its pocket near the cable slot, interconnection 216 is self-locked along both sides thereof. The splitting and staking could optionally be performed simultaneously.

FIGS. 8A through 8C illustrate a representation of another embodiment of insert 300 modified to generate self-locking in cooperation with the adapter 302 of the opposing assembly. Crests 304 of insert wave shapes 306 are chamfered at 308 along their side edges, and wave joints 310 extend entirely into respective apertures 312 of inserts 300 for wave crests 314 to be disposed therewithin. When wave joints 310 are deeply staked as in FIG. 8B, adapter wave crest 314 thereof is split; the split portions **314*a*,314*b* are forced laterally into the reliefs 316 defined by the chamfers 308. The lateral edges of split portions 314*a*,314*b* are now disposed relatively behind the split portions 314*a*,314*b* of the adjacent adapter wave crests 314 which are of the opposing adapter 302, defining a plurality of locks transversely across the termination site. After splitting, the inserts are staked at 320 as described with respect to FIG. 1, which results incidentally in the chamfer surfaces 308 being urged against the split portions 12*a*,12*b*;14*a*,14*b*** of the adjacent cable conductor strips enhancing the electrical interconnection.

The insert members of the present invention may also be used with terminals applied to an end of a single flat power cable for interconnection with another electrical article by means of contact sections extending forwardly from the terminals and outwardly from the cable end, as shown in FIG. 9. Connector 410 of FIG. 9 is described with more particularity in U.S. Pat. No. 4,915,650 and includes a housing member 412 and a rear cover member 414, adapted to house a pair of terminals 416 terminated to a dual conductor flat power cable 418. Connector 420 is matable with connector 410 and is adapted to house a corresponding pair of terminals 422 which are shown to include post sections 424 extending rearwardly from housing 426 for insertion into corresponding plated through-holes of a printed circuit board (not shown). Terminals 422 also are shown having spring arm contact sections 428 at forward ends thereof matable with splines 430 at forward ends of terminals 416, when connectors 410 and 420 are mated. Terminals 416 include stamped and formed adapter members 432 having upper and lower sections 434,436 disposed immediately against the cable, with respective insert members 438 secured along cable-remote surfaces of the upper and lower sections 434,436.

Insert members 438 of connector 410 of FIG. 9 can be identical to the inserts of either FIG. 6 or FIG. 8A. The cable end had been formed into a pair of tab sections 440 each inserted through rearward slots (not shown) of the respective terminal adapter members 432 and between initially slightly diverging upper and lower sections 434,436 after which the upper and lower sections were pressed together and rotated about integral hinges 442 at both lateral ends of the slots, for wave shapes thereof to at least press respective sheared strips of the cable conductors into opposing relief apertures of the opposing insert members, as described with reference to FIGS. 1 to 8. The wave joints thus defined were then split and the insert members staked, as before, whereafter the side walls of the apertures of the insert members 438 tightly engage edges of the conductor strips and establish gas-tight electrical connections therewith. The insert members thus establish assured electrical interconnections between the conductors of the cable and side edges of the wave shapes of the adapter members which include the contact sections of terminals 416 for electrical connection with the contact members 422 of the mating connector 420. The insert members of the present invention also establish improved mechanical securing of the upper and lower sections of each of the terminals together.

The wave crimp inserts of the present invention can be modified and varied as exemplified by the several embodiments of inserts contained herein. Similar modified and varied inserts are within the spirit of the invention and the scope of the claims.

What is claimed is:

1. An improved electrical connecting article of the type used for connecting conductor means of a flat cable to another electrical article, the connecting article comprising one of a like opposing pair of such electrical connecting articles each having a respective array of cable-engaging bosses for protruding through the plane of the flat cable into respective boss-receiving relief recesses of the opposing connecting article and pressing corresponding conductor strips out of the cable plane and into said recesses for exposed edges of said conductor strips to be laterally adjacent side walls of said relief recesses of the opposing connecting article for electrical connections therewith, the improvement comprising a pocket along a side wall of at least one said boss-receiving relief recess having a portion disposed laterally adjacent a side edge of a corresponding at least one said boss whereinto a portion of said boss is laterally forceable upon being axially split upon staking, whereby said boss portion of one of said pair of connecting articles is deformed to be disposed behind structure of the other thereof mechanically securing said connecting articles together and to said flat cable.

2. An improved electrical connecting article as set forth in claim 1 wherein each of said pair of connecting articles includes a plurality of wave shapes alternating with a like plurality of relief apertures of equal width adapted to receive thereinto a like plurality of wave shapes of the opposing one of said pair and conductor strips pressed out of the cable plane thereby upon termination, to define an array of interdigitated wave joints with said cable when applied thereto.

3. An improved electrical connecting article as set forth in claim 2 wherein each of said pair of connecting articles includes an adapter member disposed adjacent a major surface of said flat cable, and an insert member disposed securely along a cable-remote surface of a respective said adapter member and having a shape conforming to said cable-remote adapter surface, each said insert member having a like plurality of wave shapes disposed behind wave shapes of a said adapter member alternating with a like plurality of relief apertures having vertical side walls, wherein said insert members provide a substantial portion of the electrical engagement surface adjacent said edges of said conductor strips.

4. An improved electrical connecting article as set forth in claim 3 wherein said at least one pocket comprises chamfers along forwardmost portions of said wave shapes of said insert member to be disposed behind crests of wave shapes of said associated adapter member, defining recesses into which portions of split crests of wave shapes of the opposing said adapter member are laterally forceable upon being axial split upon staking, whereby said split crest portions of said adapter members are deformable to be disposed behind split crest portions of the opposing said adapter members thereof to mechanically secure said connecting articles together and to said flat cable.

5. An improved electrical connecting article as set forth in claim 1 wherein said side wall including said pocket is defined by a vertical side wall of a said boss, and said pocket is a channel extending from a cable-remote surface of said connecting article almost to a forwardmost portion of said boss.

6. An improved electrical connecting article as set forth in claim 5 wherein said channel is narrow, maximizing the surface area of said aperture side wall available to electrically engage an exposed edge of a said conductor strip disposed laterally adjacent thereto.

7. An interconnection of two flat power cables each having at least one flat conductor therein, comprising:

a first flat power cable having at least one flat conductor therein, and a second flat power cable having a corresponding at least one flat conductor therein;

at least one interconnecting structure assembly corresponding to each said at least one conductor, each said assembly having an upper structure and a lower structure joined together with selected sections of said first and second cables disposed therebetween, each said assembly having an interconnection region including a plurality of wave shapes alternating with relief recesses along a cable-proximate surface of said upper structure, and a cooperating plurality of wave shapes and alternating relief recesses along a cable-proximate surface of said lower structure, each said wave shape being opposed by a said relief recess, and said wave shapes of said upper and lower structures being adapted to at least press associated overlying conductor strips of identical width out of the cable plane and into said opposing relief recesses so that edges of said conductor strips are disposed against metal surfaces defining side edges of adjacent ones of said wave shapes for electrical connection therewith; and each of said upper and lower structures including at least one pocket along a side wall of at least one said relief recess having a portion disposed laterally adjacent a side edge of a corresponding at least one said wave shape of the opposing structure whereinto a portion of said wave shape is laterally forced upon being axially split upon staking, whereby a said split wave shape portion of each of said upper and lower structures is disposed behind a respective associated portion of the other thereof mechanically securing said upper and lower structures together and to said flat cables.

8. An interconnection as set forth in claim 7 wherein said pocket of one of said upper and lower structures is disposed near one lateral end of said assembly, and said pocket of the other thereof is disposed near the other lateral end, fastening said assembly together near both lateral ends.

9. An interconnection as set forth in claim 7 wherein said side wall including said pocket is defined by a vertical side wall of a said wave shape, and said pocket is a channel extending from a cable-remote surface of said structure almost to a forwardmost portion of said wave shape.

10. An interconnection as set forth in claim 9 wherein said channel is narrow, maximizing the surface area of said vertical side wall available to electrically engage an exposed edges of said conductor strips disposed laterally adjacent thereto.

11. An interconnection as set forth in claim 7 wherein each said upper and lower structure includes an adapter member disposed adjacent a major surface of one of said first and second cables and having wave shapes alternating with relief recesses, and an insert member disposed securely along a cable-remote surface of a respective said adapter member and having wave shapes disposed behind said adapter wave shapes and alternating with relief apertures, wherein side walls of said relief apertures of said insert members provide a substantial portion of the electrical engagement surface adjacent said edges of said conductor strips.

12. An interconnection as set forth in claim 11 wherein said at least one pocket comprises chamfers along forwardmost portions of said wave shapes of said insert member to be disposed behind crests of wave shapes of said associated adapter member, defining recesses into which portions of split crests of wave shapes of the opposing said adapter member are laterally forceable upon being axial split upon staking, whereby said split crest portions of said adapter members are deformable to be disposed behind split crest portions of the opposing said adapter members thereof to mechanically secure said connecting articles together and to said flat cables.

13. An assembly for interconnecting first and second flat power cables each having at least one flat conductor therein, comprising:

at least one interconnecting structure assembly corresponding to each said at least one conductor, each said assembly having an upper structure and a lower structure adapted to be matable therewith to be joined together upon application to said first and second cables with selected sections of said first and second cables disposed therebetween, each said assembly having an interconnection region including a plurality of wave shapes alternating with relief recesses along a cable-proximate surface of said upper structure, and a cooperating plurality of wave shapes and alternating relief recesses along a cable-proximate surface of said lower structure, each said wave shape being opposed by a said relief recess, and said wave shapes of said upper and lower structures being adapted to at least press associated overlying sheared conductor strips of identical width out of the cable plane and into said opposing relief recesses so that edges of said conductor strips will be disposed against metal surfaces defining side edges of adjacent ones of said wave shapes for electrical connection therewith; and each of said upper and lower structures including at least one pocket along a side wall of at least one said relief recess having a portion disposed laterally adjacent a side edge of a corresponding at least one said wave shape of the opposing structure whereinto a portion of said wave shape is laterally forceable upon being axially split upon staking, whereby a said split wave shape portion of each of said upper and lower structures will be disposed behind a respective associated portion of the other thereof mechanically securing said upper and lower structures together and to said flat cables.

14. An assembly as set forth in claim 13 wherein said pocket of one of said upper and lower structures is disposed near one lateral end of said assembly, and said pocket of the other thereof is disposed near the other lateral end, fastening said assembly together near both lateral ends.

15. An assembly as set forth in claim 13 wherein said side wall including said pocket is defined by a vertical side wall of a said wave shape, and said pocket is a channel extending from a cable-remote surface of said structure almost to a forwardmost portion of said wave shape.

16. An assembly as set forth in claim 15 wherein said channel is narrow, maximizing the surface area of said vertical side wall available to electrically engage an exposed edge of a said conductor strip disposed laterally adjacent thereto.

17. An assembly as set forth in claim 13 wherein each said upper and lower structure includes an adapter member disposed adjacent a major surface of one of said first and second cables and having wave shapes alternating with relief recesses, and an insert member disposed securely along a cable-remote surface of a respective said adapter member and having wave shapes disposed behind said adapter wave shapes and alternating with relief apertures, wherein side walls of said relief apertures of said insert members provide a substantial portion of the electrical engagement surface adjacent said edges of said conductor strips.

18. An assembly as set forth in claim 17 wherein said at least one pocket comprises chamfers along forwardmost portions of said wave shapes of said insert member to be disposed behind crests of wave shapes of said associated adapter member, defining recesses into which portions of split crests of wave shapes of the opposing said adapter member are laterally forceable upon being axial split upon staking, whereby said split crest portions of said adapter members are deformable to be disposed behind split crest portions of the opposing said adapter members thereof to mechanically secure said connecting articles together and to said flat cables.

19. A terminal for terminating an end portion of flat power cable having at least one insulated conductor, comprising:

a conductive member including a forward contact section and having an upper structure and a lower structure adapted to be matable therewith joined together in a manner defining a cable-receiving space therebetween for application to said cable end portion disposed therebetween, said upper structure having an interconnection region including a plurality of cable-engaging bosses alternating with boss-receiving relief recesses disposed transversely across a cable-proximate surface of said upper structure, and a cooperating plurality of cable-engaging bosses and alternating boss-receiving relief recesses disposed transversely across a cable-proximate surface of said lower structure, each said boss being opposed by a said relief recess, and said bosses of said upper and lower structures being adapted to at least press associated overlying sheared conductor strips of identical width out of the cable plane and into said opposing relief recesses so that edges of said conductor strips will be disposed laterally adjacent side edges of adjacent bosses for electrical connection therewith; and each of said upper and lower structures including at least one pocket along a side wall of at least one said relief recess having a portion disposed laterally adjacent a side edge of a corresponding at least one said boss of the opposing structure whereinto a portion of said boss is laterally forceable upon being axially split upon staking, whereby a said split boss portion of each of said upper and lower structures will be disposed behind a respective associated portion of the other thereof mechanically securing said upper and lower structures together and to said flat cable.

20. A terminal as set forth in claim 19 wherein said pocket of one of said upper and lower structures is disposed near one lateral end thereof, and said pocket of the other thereof is disposed near a lateral end opposed from said one lateral end, fastening said upper and lower structures together near both lateral ends.

21. A terminal as set forth in claim 19 wherein opposing upper and lower plate sections extend forwardly from a laterally spaced pair of hinges defining a cable-receiving slot therebetween, said upper and lower plate sections including transverse termination regions thereacross containing respective arrays of cable-engaging bosses adapted to press respective strips of the cable conductor into respective opposed relief recesses of the opposing said plate section; and an insert member is disposed securely along a cable-remote surface of each of said upper and lower plate sections and includes wave shapes disposed behind said adapter wave shapes and alternating with relief apertures, wherein side walls of said relief apertures of said insert members provide a substantial portion of the electrical engagement surface adjacent said edges of said conductor strips.

22. A terminal as set forth in claim 21 wherein said at least one pocket comprises chamfers along forwardmost portions of said wave shapes of each said insert member to be disposed behind crests of wave shapes of said associated adapter member, defining recesses into which portions of split crests of wave shapes of the opposing said adapter member are laterally forceable upon being axial split upon staking, whereby said split crest portions of said adapter members are deformable to be disposed behind split crest portions of the opposing said adapter members thereof to mechanically secure said upper and lower plate sections together and to said flat cable.

23. A terminal as set forth in claim 21 wherein said side wall including said pocket is defined by a vertical side wall of a said wave shape, and said pocket is a channel extending from a cable-remote surface of said structure almost to a forwardmost portion of said wave shape.

24. A terminal as set forth in claim 23 wherein said channel is narrow, maximizing the surface area of said vertical side wall available to electrically engage an exposed edge of a said conductor strip disposed laterally adjacent thereto.

25. A method of securing electrical connecting articles to opposed major surfaces of at least one flat cable, the connecting articles being of the type having arrays of cable-engaging bosses alternating with boss-receiving relief recesses, said bosses of each said connecting article adapted to at least press respective sheared conductor strips out of the plane of the cable into opposed ones of said relief recesses of the opposing said connecting article defining an array of interdigitated joints, so that exposed edges of said conductor strips are exposed for electrical connection therewith, comprising the steps of:

forming pockets into the side walls of at least two of said boss-receiving relief recesses, rearwardly of the cable-proximate entrance of said relief recesses;

forming the cable-engaging bosses of each said connecting article to include forwardmost portions dimensioned to protrude beyond the remote surface of the plane of the cable for side edges of said forwardmost portions to be disposed within said at least two of said boss-receiving relief recesses of the other said connecting article and laterally adjacent said pockets; and axially splitting said joints deeply enough to split said forwardmost portions of said bosses and force the split portions laterally into said pockets, whereby a said split boss portion of each of said connecting articles will be disposed behind a respective associated portion of the other thereof mechanically securing said connecting articles together and to said flat cable.

26. The method as set forth in claim 25 wherein said side wall including said pocket is defined by a vertical side wall of a said boss, and said pocket is a channel extending from a cable-remote surface of said connecting article almost to a forwardmost portion of said boss.

* * * * *